US009494168B2

(12) United States Patent
Lind et al.

(10) Patent No.: US 9,494,168 B2
(45) Date of Patent: Nov. 15, 2016

(54) ENERGY EFFICIENT FLUID POWERED LINEAR ACTUATOR WITH VARIABLE AREA AND CONCENTRIC CHAMBERS

(71) Applicant: UT-Battelle, LLC, Oak Ridge, TN (US)

(72) Inventors: Randall F. Lind, Loudon, TN (US); Lonnie J. Love, Knoxville, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 290 days.

(21) Appl. No.: 14/468,629

(22) Filed: Aug. 26, 2014

(65) Prior Publication Data

US 2016/0061229 A1 Mar. 3, 2016

(51) Int. Cl.

*F15B 11/00* (2006.01)
*F15B 11/036* (2006.01)
*F15B 21/14* (2006.01)

(52) U.S. Cl.

CPC ..... *F15B 11/006* (2013.01); *F15B 11/036* (2013.01); *F15B 21/14* (2013.01); *F15B 2211/30575* (2013.01); *F15B 2211/625* (2013.01); *F15B 2211/6336* (2013.01); *F15B 2211/7055* (2013.01); *F15B 2211/7107* (2013.01); *F15B 2211/761* (2013.01); *F15B 2211/88* (2013.01)

(58) Field of Classification Search

CPC ..... F15B 21/14; F15B 2011/0243; F15B 11/036; F15B 2211/7135

USPC ..... 60/414; 92/108, 109

See application file for complete search history.

(56) References Cited

U.S. PATENT DOCUMENTS 3,353,352 A * 11/1967 Gardner ..... F15B 1/024 60/406
3,603,207 A * 9/1971 Parrett ..... F15B 15/16 91/167 R
3,779,135 A * 12/1973 Sugimura ..... F15B 11/076 60/407
4,296,677 A * 10/1981 Little ..... F15B 15/1466 91/510
4,414,808 A * 11/1983 Benson ..... F04B 47/04 417/402
4,531,451 A * 7/1985 Mouton ..... F15B 11/036 91/519
4,907,495 A * 3/1990 Sugahara ..... F15B 11/076 188/300
4,947,732 A * 8/1990 Hidenobu ..... F15B 9/03 73/745
5,090,296 A * 2/1992 Todd ..... F15B 15/204 91/518

(Continued)

OTHER PUBLICATIONS

Yamada, et al., Energy Saving System for Hydraulic Excavator (Simulation of Power Assistant System with Accumulator), Proceedings of the 6th JFPS International Symposium on Fluid Power, 2005, pp. 646-651.

*Primary Examiner* — Thomas E Lazo
(74) *Attorney, Agent, or Firm* — Colin L. Cini

(57) ABSTRACT

Hydraulic actuation systems having concentric chambers, variable displacements and energy recovery capabilities include cylinders with pistons disposed inside of barrels. When operating in energy consuming modes, high speed valves pressurize extension chambers or retraction chambers to provide enough force to meet or counteract an opposite load force. When operating in energy recovery modes, high speed valves return a working fluid from extension chambers or retraction chambers, which are pressurized by a load, to an accumulator for later use.

11 Claims, 15 Drawing Sheets

(56) References Cited

U.S. PATENT DOCUMENTS

| | | | | |
|---|---|---|---|---|
| 5,971,027 | A * | 10/1999 | Beachley | F15B 3/00 138/30 |
| 6,467,264 | B1 * | 10/2002 | Stephenson | F15B 11/006 60/368 |
| 6,748,738 | B2 * | 6/2004 | Smith | E02F 9/2217 60/414 |
| 7,107,767 | B2 | 9/2006 | Frazer et al. | |
| 7,325,398 | B2 | 2/2008 | Cherney | |
| 7,434,391 | B2 | 10/2008 | Asam et al. | |
| 7,441,405 | B2 * | 10/2008 | Aarestad | E02F 9/2217 60/413 |
| 7,475,538 | B2 * | 1/2009 | Bishop | E02F 9/22 60/567 |
| 7,634,911 | B2 | 12/2009 | Brinkman | |
| 7,712,309 | B2 | 5/2010 | Vigholm | |
| 7,823,379 | B2 | 11/2010 | Hamkins et al. | |
| 7,905,088 | B2 | 3/2011 | Stephenson et al. | |
| 9,021,798 | B2 * | 5/2015 | Sipola | F15B 11/036 60/428 |
| 2003/0213238 | A1 * | 11/2003 | Smith | E02F 9/2217 60/413 |
| 2010/0018195 | A1 | 1/2010 | Stanger et al. | |
| 2011/0259187 | A1 * | 10/2011 | Sipola | F15B 11/036 91/59 |
| 2012/0180470 | A1 * | 7/2012 | Schroeder | E02F 9/2217 60/414 |

* cited by examiner

| VALVE NUMBER (0=Closed, 1=Open) | | | | | | | | FORCE |
|---|---|---|---|---|---|---|---|---|
| V1 | V2 | V3 | V4 | V5 | V6 | V7 | V8 | |
| 0 | 1 | 0 | 1 | 0 | 1 | 0 | 1 | 0 |
| 0 | 1 | 1 | 0 | 0 | 1 | 0 | 1 | +P(Ax) |
| 0 | 1 | 1 | 0 | 0 | 1 | 1 | 0 | +P(Ax+Ay) |
| 1 | 0 | 1 | 0 | 0 | 1 | 0 | 1 | +P(Arx) |
| 1 | 0 | 1 | 0 | 1 | 0 | 1 | 0 | +P(Arx+Ary) |
| 0 | 1 | 0 | 1 | 1 | 0 | 1 | 0 | +P(Ary) |
| 0 | 1 | 1 | 0 | 1 | 0 | 0 | 1 | +P(Ax-Aey) |
| 1 | 0 | 0 | 1 | 1 | 0 | 0 | 1 | -P(Aex+Aey) |
| 1 | 0 | 0 | 1 | 0 | 1 | 0 | 1 | -P(Aex) |
| 0 | 1 | 0 | 1 | 1 | 0 | 0 | 1 | -P(Aey) |
| 1 | 0 | 0 | 1 | 1 | 0 | 0 | 1 | -P(Aex-Ay) |
| 1 | 0 | 0 | 1 | 0 | 1 | 0 | 1 | +L(Aex) |
| 0 | 1 | 0 | 1 | 1 | 0 | 0 | 1 | +L(Aey) |
| 1 | 0 | 0 | 1 | 1 | 0 | 0 | 1 | +L(Aex+Aey) |
| 0 | 1 | 1 | 0 | 0 | 1 | 0 | 1 | -L(Ax) |
| 0 | 1 | 0 | 1 | 0 | 1 | 1 | 0 | -L(Ay) |
| 0 | 1 | 1 | 0 | 0 | 1 | 1 | 0 | -L(Ax+Ay) |

FIG. 8

| VALVE NUMBER (0=Closed, 1=Open) | | | | | | FORCE |
|---|---|---|---|---|---|---|
| V1 | V2 | V3 | V4 | V5 | V6 | |
| 0 | 1 | 0 | 1 | 0 | 1 | 0 |
| 1 | 0 | 0 | 1 | 0 | 1 | +P(A1) |
| 0 | 1 | 1 | 0 | 0 | 1 | +P(A2) |
| 0 | 1 | 0 | 1 | 1 | 0 | +P(A3) |
| 1 | 0 | 1 | 0 | 0 | 1 | +P(A1+A2) |
| 0 | 1 | 1 | 0 | 1 | 0 | +P(A2+A3) |
| 1 | 0 | 0 | 1 | 1 | 0 | +P(A1+A3) |
| 1 | 0 | 1 | 0 | 1 | 0 | +P(A1+A2+A3) |
| 1 | 0 | 0 | 1 | 0 | 1 | -L(A1) |
| 0 | 1 | 1 | 0 | 0 | 1 | -L(A2) |
| 0 | 1 | 0 | 1 | 1 | 0 | -L(A3) |
| 1 | 0 | 1 | 0 | 0 | 1 | -L(A1+A2) |
| 0 | 1 | 1 | 0 | 1 | 0 | -L(A2+A3) |
| 1 | 0 | 0 | 1 | 1 | 0 | -L(A1+A3) |
| 1 | 0 | 1 | 0 | 1 | 0 | -L(A1+A2+A3) |

FIG. 11

ENERGY EFFICIENT FLUID POWERED LINEAR ACTUATOR WITH VARIABLE AREA AND CONCENTRIC CHAMBERS

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in the invention.

CROSS-REFERENCE TO RELATED APPLICATIONS

This application relates to U.S. patent application Ser. No. 14/468,611, entitled, ENERGY EFFICIENT FLUID POWERED LINEAR ACTUATOR WITH VARIABLE AREA, filed on 26 Aug. 2014.

THE NAMES OF THE PARTIES TO A JOINT RESEARCH AGREEMENT

None.

BACKGROUND OF THE INVENTION

1. Field of the Invention

The present disclosure relates to power transmission and more specifically to linear actuators for providing multiple, discrete, forces and recovering energy from loads handled by such actuators.

2. Description of the Related Art

A hydraulic actuator is a device which converts hydraulic energy into mechanical force or motion. Actuators may be defined as those with linear movement and those with rotary movement. Linear actuators may be further sub-divided into those where hydraulic pressure is applied to one side of a piston only (single acting) and capable of controlled movement in only one direction, and those where hydraulic pressure may be applied to both sides of the piston (double acting) and capable of controlled movement in both directions. Linear actuators may also be classified as single-ended, which have an extension rod on one end of the piston only, or double-ended, which have rods on both ends of the piston. Single-ended actuators are useful in space constrained applications, but unequal areas on each side of the piston results in asymmetrical flow gain which can complicate the control system. Double-ended actuators have the advantage of producing equal force and speed in both directions, and for this reason are sometimes called symmetric or synchronizing cylinders.

Hydraulic actuator cylinders receive their power from pressurized hydraulic fluid, which is typically oil that is pressurized by a hydraulic pump. In some applications, the cylinders are powered pneumatically by a gas such as air that is pressurized by a compressor. The hydraulic cylinder includes a cylinder barrel, inside of which a piston moves back and forth. The barrel is closed on one end by the cylinder bottom (also called the cap) and the other end by the cylinder head (also called the gland) where a connected piston rod comes out of the cylinder to engage a load. The piston has sliding rings and seals to contain the pressurized fluid and prevent leakage. The piston divides the interior volume of the cylinder into two chambers, the bottom chamber (cap end) and the piston rod side chamber (rod end/head end). Single-acting hydraulic cylinders produce forces in only one direction (in or out) and double-acting hydraulic cylinders produce forces in two directions (in and out).

Hydraulic actuators are sized for the largest load they are expected to encounter in service. Conventional hydraulic actuation systems are very often inefficient because the load and the actuator force are mismatched and a control valve must be used to throttle the high pressure working fluid flow to the actuator. This throttling action wastes pumping energy, produces heat, and reduces the overall efficiency of the system. These systems also have no way of capturing energy from a load force that is in the same direction as the motion of the piston, such as when a load is under the force of gravity.

What are needed are hydraulic actuation systems having variable displacements and energy recovery capabilities.

BRIEF DESCRIPTION OF THE SEVERAL VIEWS OF THE DRAWINGS

The systems may be better understood with reference to the following drawings and enabling description. Non-limiting and non-exhaustive descriptions are described with reference to the following drawings. The components in the figures are not necessarily to scale, emphasis instead being placed upon illustrating principles. In the figures, like referenced numerals may refer to like parts throughout the different figures and examples unless otherwise specified.

FIG. 8 is a table listing some of the discrete forces provided by the system of FIG. 7.

FIG. 11 is a table listing some of the discrete forces provided by the system of FIG. 10.

DETAILED DESCRIPTION OF THE INVENTION

Figure 1:
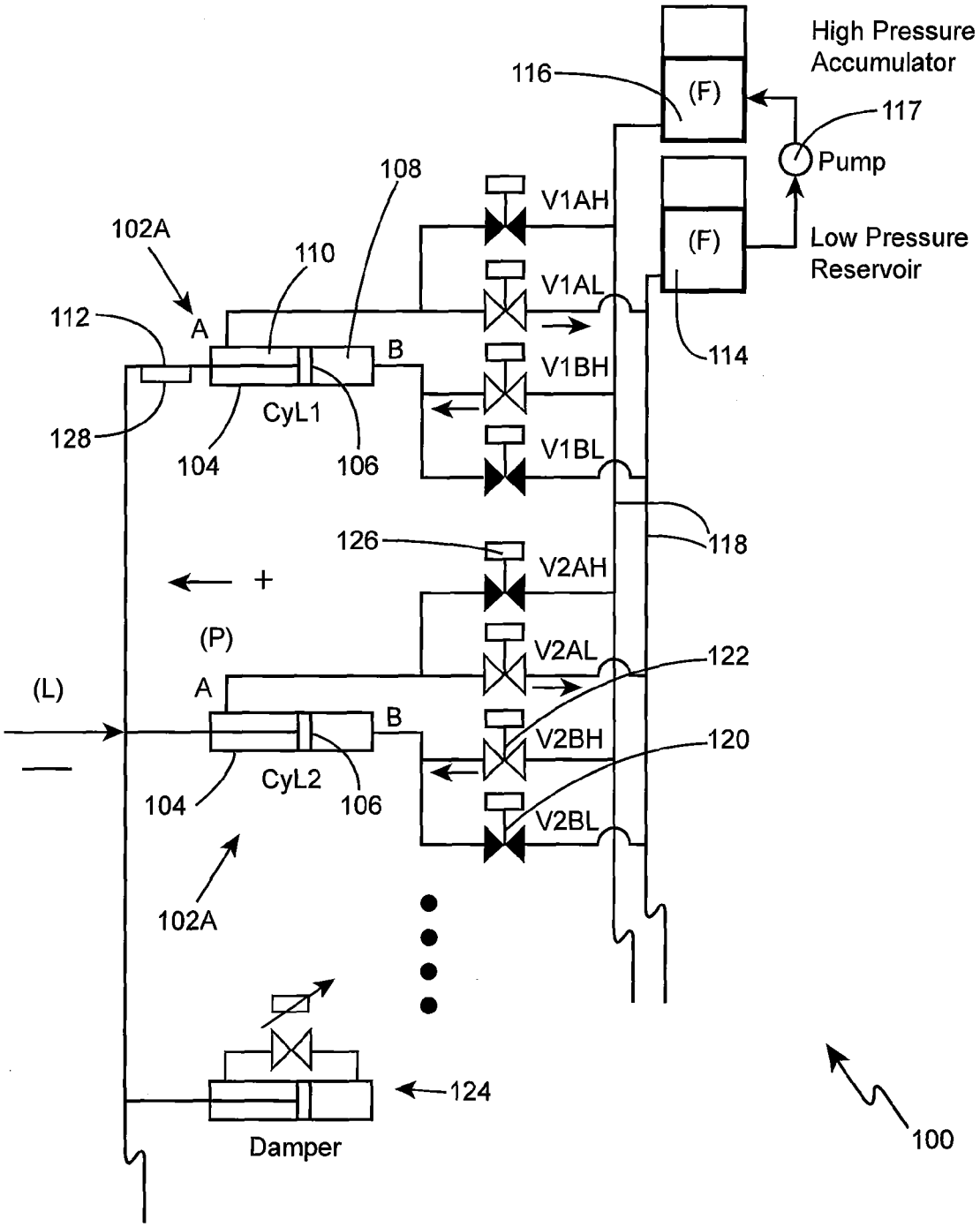
FIG. 1 is a schematic illustration of a double-acting, hydraulic actuation system configured in an energy consuming mode where the load force (−L) is in an opposite direction as an extending piston force (+P) and having at least two active cylinders.

Referring to the examples illustrated in FIGS. 1-6, a hydraulic actuation system 100 includes two or more double-acting hydraulic cylinders 102. While only two identically-sized cylinders 102 are shown in these particular examples, the size and number of cylinders 102 are defined by the range of discrete loads expected. For example, three cylinders 102 could be included, or more than three cylinders 102 could be included. Each cylinder 102 includes a barrel 104 that defines an interior volume. A moveable piston 106 fits within the barrel 104 and partitions the volume into an extension chamber 108 and a retraction chamber 110. A piston rod 112 is affixed to the piston 106 and extends outward from the cylinder 102 through the retraction chamber 110. Since hydraulic cylinders 102 are well known in the art, other details such as materials, fittings, scrapers, seals, clips and rings are not included in this description.

Each chamber 108, 110 of each cylinder 102 is fluidly coupled to each of a low pressure reservoir 114 and a high pressure accumulator 116. In some examples, a pump 117 is fluidly coupled to and disposed between the low pressure reservoir 114 and a high pressure accumulator 116. The terms "fluidly coupled", "fluidly coupling", "fluidly connected" and "fluidly connecting" refer to components or chambers sharing a common working fluid (F) and capable of transferring the fluid (F) between components in a closed-loop arrangement. In some embodiments, the components are fluidly coupled directly together, and, in other embodiments, the components are fluidly coupled together by closed conduits 118 such as tubes, lines, hoses or the like. In a typical system 100, an upstream component delivers the working fluid (F) to a downstream component, and the downstream component receives the working fluid (F) from the upstream component.

A low pressure valve 120 fluidly couples each chamber 108, 110 to the low pressure reservoir 114 and a high pressure valve 122 fluidly couples each chamber 108, 110 to the high pressure accumulator 116. These valves 120, 122 may be high speed, solenoid-operated valves or other types of valves with the ability to be rapidly configured between a fully opened position and fully closed position. The illustrations include schematics with standard valve symbols, which are indicative of the valve position in each of the system examples to be described. A valve symbol including no fill is indicative of an open valve configuration, and a valve symbol including fill is indicative of a closed valve configuration.

A damper 124 may be coupled to the one or more piston rods 112. The damper 124 may be adjustable to provide for variable damping of the system 100. The damper 124 functions to smooth out the discretely changing forces produced by the two or more cylinders 102 acting on the load (L). Note that the load (L) may be permanently affixed to the piston rods 112 as in a robotic joint application, or may be in transitory contact with the load (L) as in the material loading or heavy equipment applications.

For a minimum load (L) mass, only one or two cylinders 102A may need to be activated to displace the load or recover energy from the load. For a greater load (L) mass, even more cylinders can be activated until all the cylinders are active and contributing to the force applied to the load or recovery of energy from the load. The extra cylinders that are not contributing to the force required to overcome the load are called passive cylinders 102P.

A servo position controller 126 manages the flow of high pressure fluid (F) via the valves 120, 122 to and from the active 102A and passive cylinders 102P and the low pressure reservoir 114 and high pressure accumulator 116. A position demand is made manually or automatically through the servo controller 126. The valves 120, 122 activate as many cylinders 102A as are necessary to match or overcome the force of the load (L) acting on the system 100. As the piston rods 112 move, their travel is monitored by a displacement transducer 128, which, in turn, is connected to the servo controller 126 to provide displacement feedback from each of the cylinders 102. When displacement is indicated, then the correct number of cylinders is active. If no displacement is detected, then more cylinders must be activated. A digital signal processor (DSP) from TEXAS INSTRUMENTS is a suitable controller for a hydraulic system 100 as described in the examples. Position transducers 128 are usually collocated with the cylinders 102, and often attached directly to the piston rod 112 itself. Various types of feedback transducers 128 may be used, including incremental or absolute encoders, inductive linear variable differential transformer, linear potentiometers, and resolvers.

Figure 5:
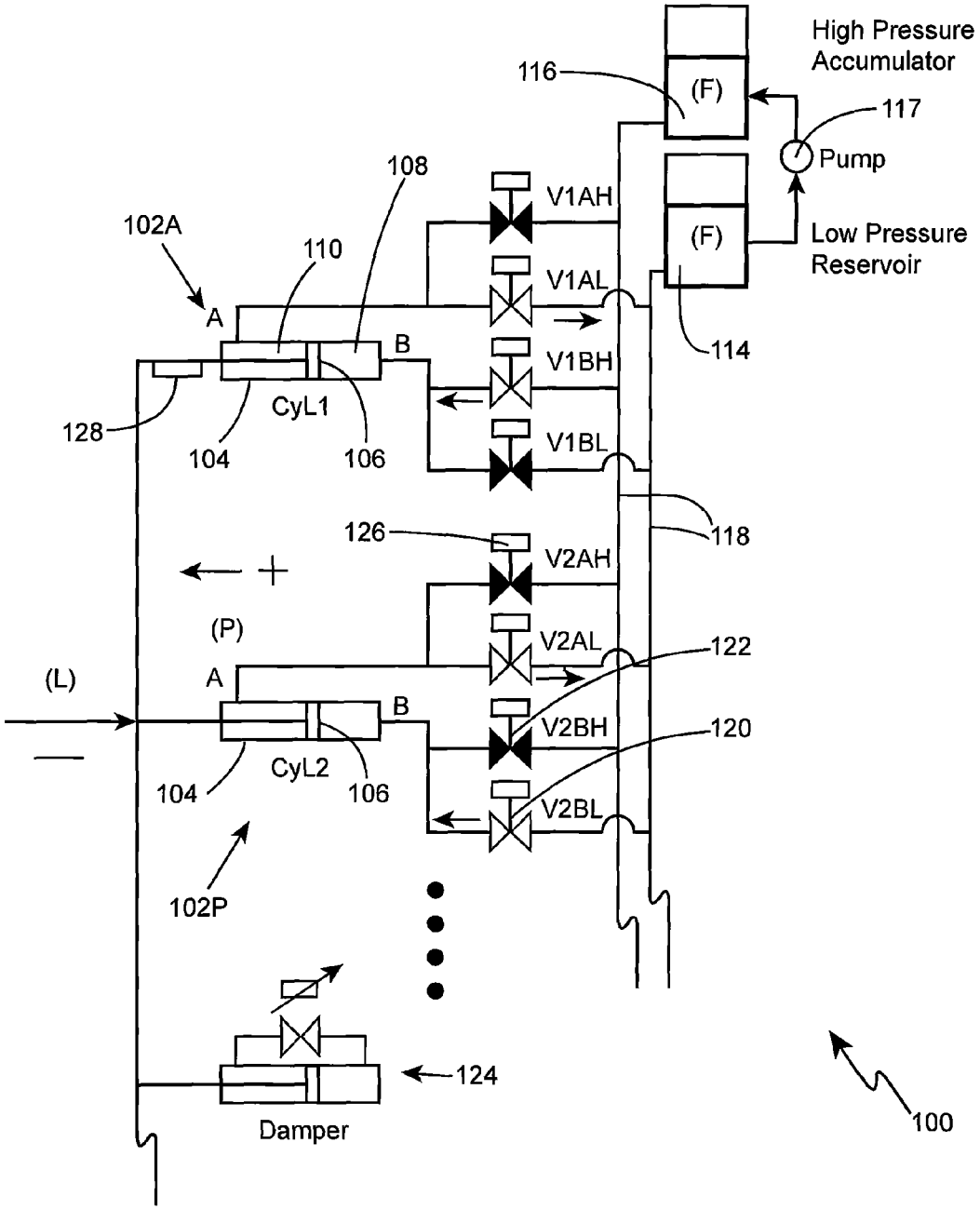
FIG. 5 is a schematic illustration of the system of FIG. 1 configured in an energy consuming mode where the load force (−L) is in an opposite direction as an extending piston force (+P) and having at least one active cylinder and one passive cylinder.

FIGS. 1 and 5 illustrate a system 100, which is configured in an energy consuming mode with a piston 106 extending outwardly from each of the active cylinders 102A. Please note that the load force direction (−L) is in an opposite direction as the piston 106 force direction (+P) in these examples. This is indicative of the energy consuming mode, where energy is supplied to the load (L) by the system 100, pushing the load (L) away from the system 100.

For each of the active cylinders 102A, the low pressure valve 120 fluidly coupling the retraction chamber 110 to the low pressure reservoir 114 and the high pressure valve 122 fluidly coupling the extension chamber 108 to the high pressure accumulator 116 are configured in an open position. The high pressure valve 122 fluidly coupling the retraction chamber 110 to the high pressure accumulator 116 and the low pressure valve 120 fluidly coupling the extension chamber 108 to the low pressure reservoir 114 are configured in a closed position. For each of the passive cylinders 102P (FIG. 5), the high pressure valves 122 are configured in a closed position and the low pressure valves 120 are configured in an open configuration.

Figure 2:
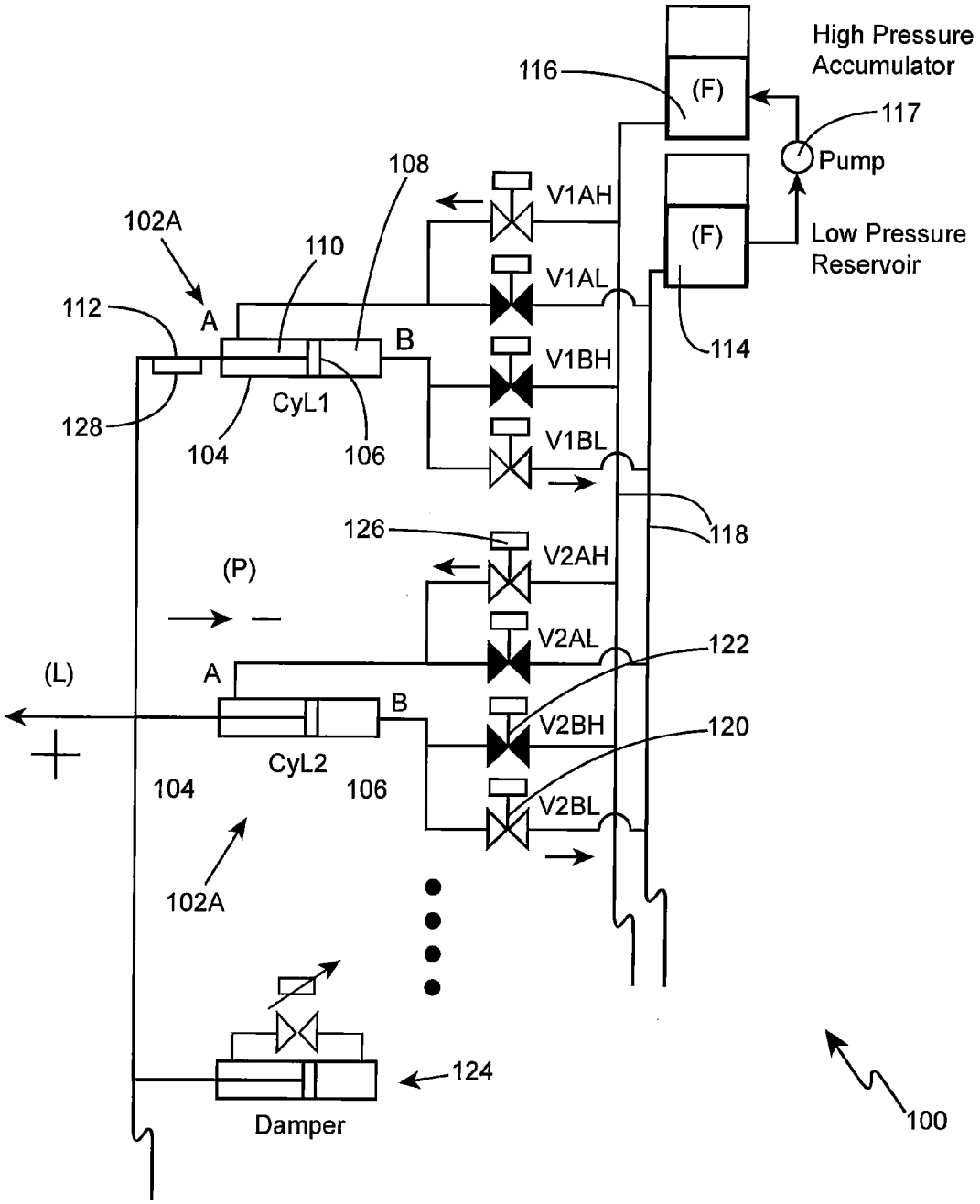
FIG. 2 is a schematic illustration of the system of FIG. 1 configured in an energy consuming mode where the load force (+L) is in an opposite direction as a retracting piston force (−P) and having at least two active cylinders.

FIG. 2 illustrates a system 100, which is configured in an energy consuming mode with a piston 106 retracting inwardly into each of the active cylinders 102A. Please note that the load force direction (+L) is in an opposite direction as the piston 106 force direction (−P) in this example. This is indicative of the energy consuming mode, where energy is supplied to the load (L) by the system 100, pulling the load (L) towards the system 100.

For each of the active cylinders 102A, the high pressure valve 122 fluidly coupling the retraction chamber 110 to the high pressure accumulator 116 and the low pressure valve 120 fluidly coupling the extension chamber 108 to the low pressure reservoir 114 are configured in an open position. Also, the low pressure valve 120 fluidly coupling the retraction chamber 110 to the high pressure accumulator 116 and the high pressure valve 122 fluidly coupling the extension chamber 108 to the high pressure accumulator 116 are configured in a closed position. For each of the passive cylinders 102P, the high pressure valves 122 are configured in a closed position and the low pressure valves 120 are configured in an open configuration.

Figure 3:
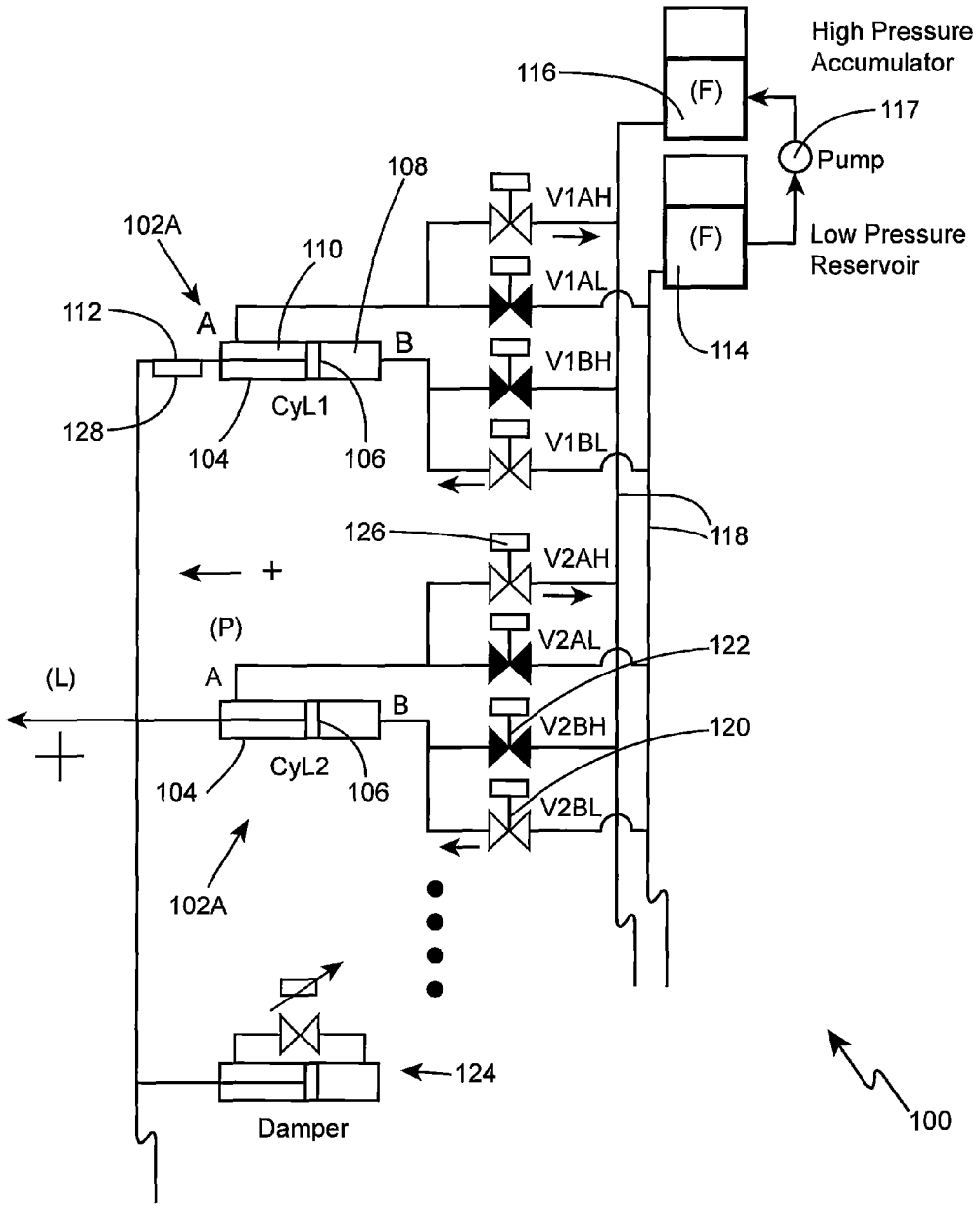
FIG. 3 is a schematic illustration of the system of FIG. 1 configured in an energy recovery mode where the load force (+L) is in the same direction as an extending piston force (+P) and having at least two active cylinders.
Figure 6:
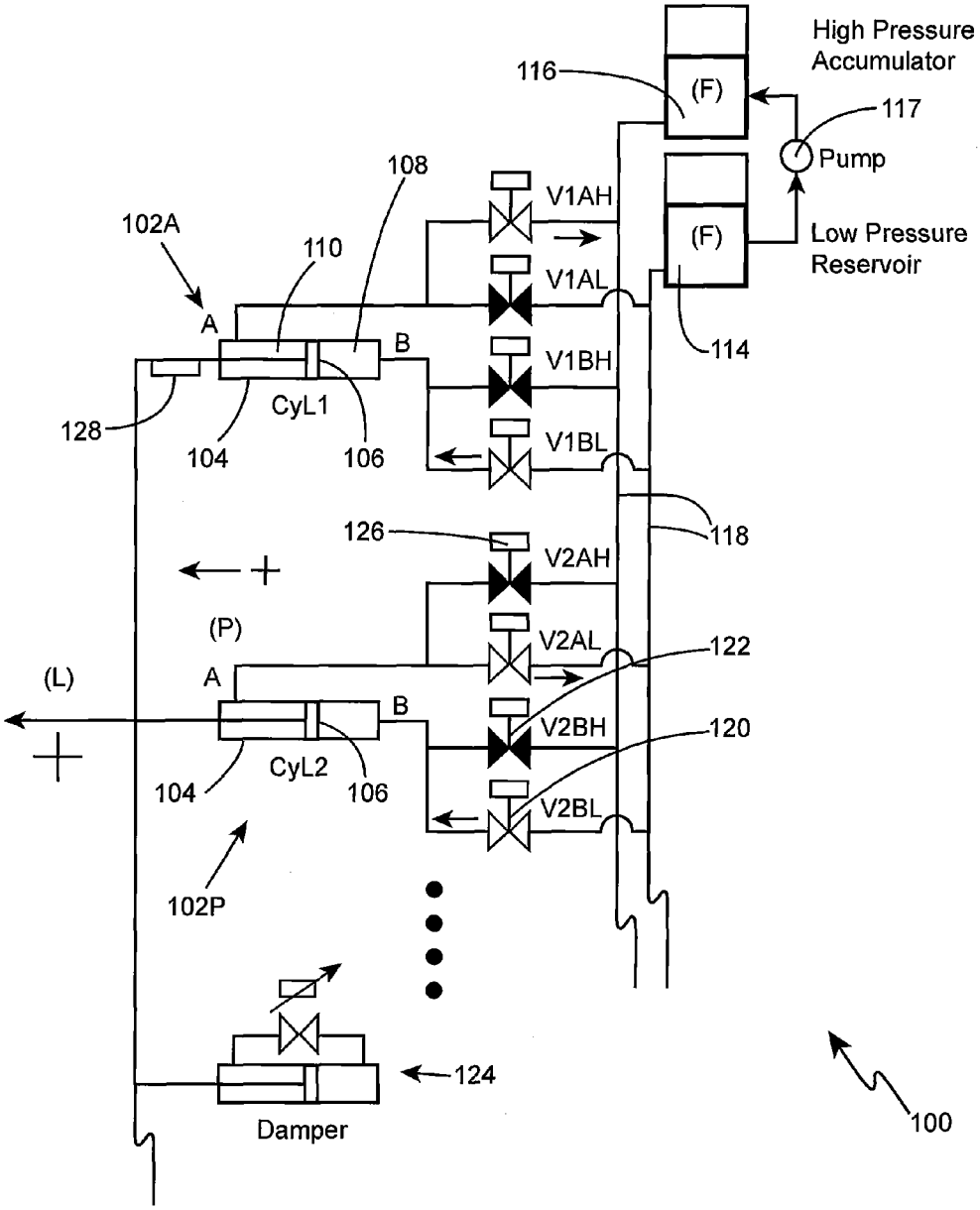
FIG. 6 is a schematic illustration of the system of FIG. 1 configured in an energy recovery mode where the load force (+L) is in the same direction as an extending piston force (+P) and having at least one active cylinder and one passive cylinder.

FIGS. 3 and 6 illustrate a system 100, which is configured in an energy recovery mode with a piston 106 extending outwardly from each of the active cylinders 102A. Please note that the load force direction (+L) is in the same direction as the piston direction (+P). This is indicative of the energy recovery mode, where energy is supplied by the load (L) to the system 100, extending the piston 106 out of the active cylinder 102A.

For each of the active cylinders 102A, the low pressure valve 120 fluidly coupling the retraction chambers 110 to the low pressure reservoir 114 and the high pressure valve 122 fluidly coupling the extension chamber 108 to the high pressure accumulator 116 are configured in an open position. Also, the high pressure valve 122 fluidly coupling the retraction chambers 110 to the high pressure accumulator 116 and the low pressure valve 120 fluidly coupling the extension chamber 108 to the low pressure reservoir 114 are configured in a closed position. For each of the passive cylinders 102P in FIG. 6, the high pressure valves 122 are configured in a closed position and the low pressure valves 120 are configured in an open configuration.

Figure 4:
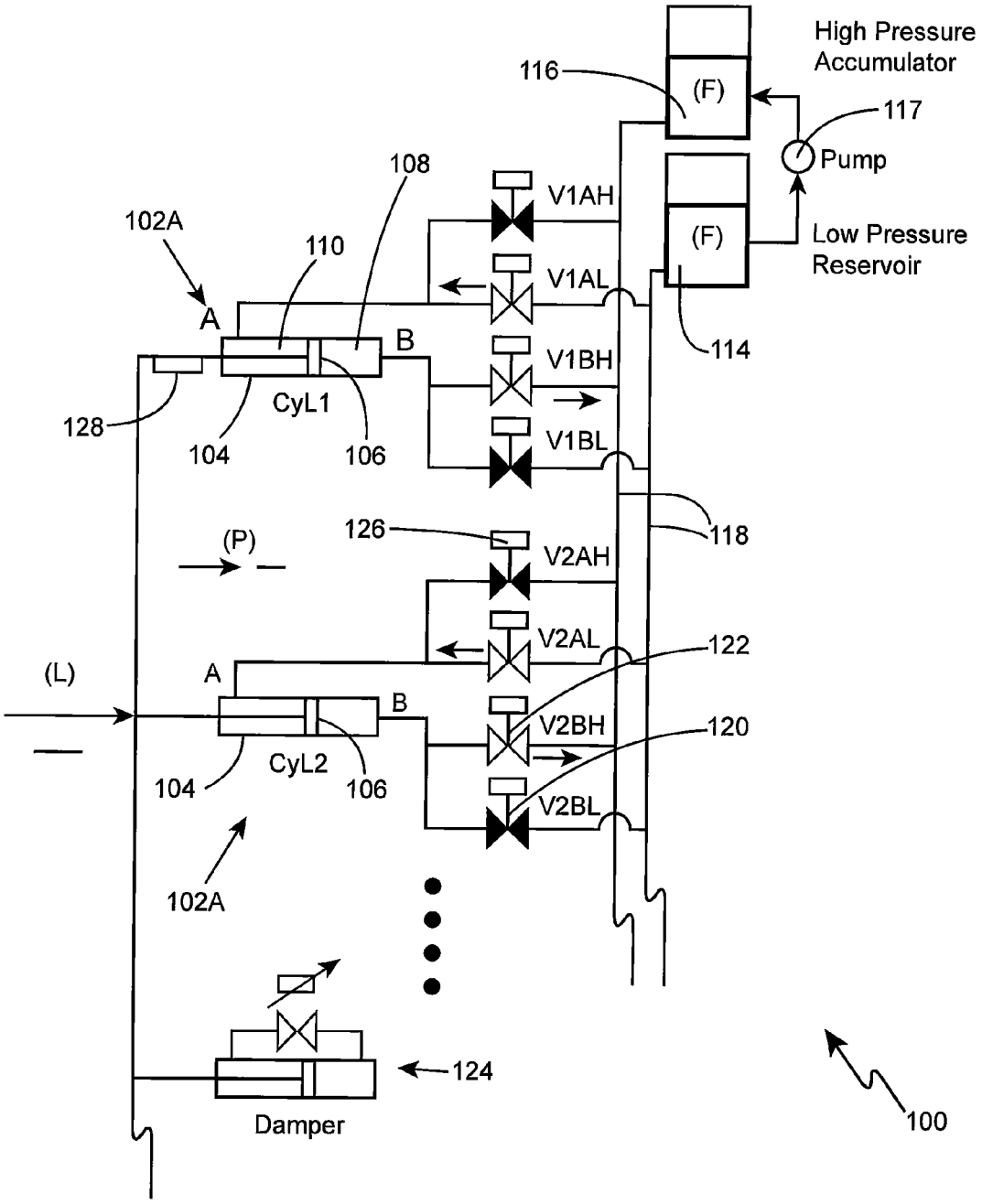
FIG. 4 is a schematic illustration of the system of FIG. 1 configured in an energy recovery mode where the load force (−L) is in the same direction as a retracting piston force (−P) and having at least two active cylinders.

FIG. 4 illustrates a system 100, which is configured in an energy recovery mode with a piston 106 retracting inwardly into each of the active cylinders 102A. Note that the load force direction (−L) is in the same direction as the piston 106 direction (−P). This is indicative of the energy recovery mode, where energy is supplied by the load (L) to the system 100, retracting the piston 106 into the active cylinder 102A.

For each of the active cylinders 102A, the low pressure valve 120 fluidly coupling the retraction chamber 110 to the low pressure reservoir 114 and the high pressure valve 122 fluidly coupling the extension chamber 108 to the high pressure accumulator 116 are configured in an open position. Also, the high pressure valve 122 fluidly coupling the retraction chamber 110 to the high pressure accumulator 116 and the low pressure valve 120 fluidly coupling the extension chamber 108 to the low pressure reservoir 114 are configured in a closed position. For each of the passive cylinders 102P, the high pressure valves 122 are configured in a closed position and the low pressure valves 120 are configured in an open configuration.

Figure 7:
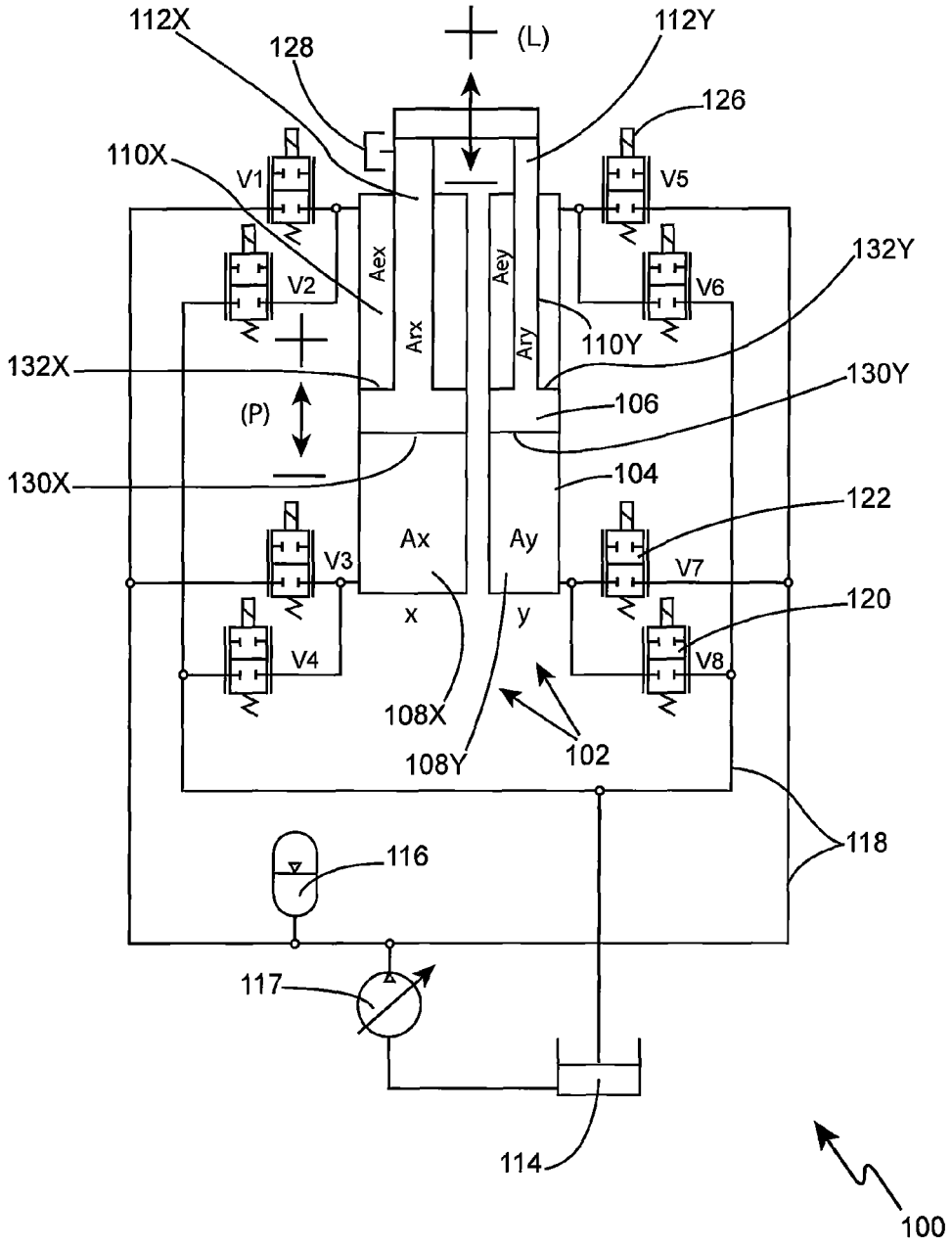
FIG. 7 is a schematic illustration of a double-acting, hydraulic actuation system having two cylinders with different sized piston, piston rod and effective areas.

FIG. 7 illustrates a system 100 having cylinders 102, extension chambers 108, retraction chambers 110, pistons 106 and piston rods 112 of different sizes. With this particular configuration, a broad range of discrete forces is possible with fewer cylinders. While only two cylinders 102 are shown, it is to be understood that the number and size of cylinders is not limited and are chosen based on the expected range of loads (L).

This system 100 is also configured to function in energy consuming and energy recovery modes as described in the earlier examples. To capture energy from the system when the load force (L) is in the same direction as the piston 106 movement, the effective area of the cylinders is adjusted so that the correct retarding force is created by the working fluid (F) pressure. In the energy recovery modes, high pressure fluid (F) is returned under pressure to the high pressure accumulator 116 for storage and later use. In order to have good velocity control, it may be necessary to provide some minimal throttling of the fluid flow. In these systems 100, the losses for throttling are much lower than for traditional systems because of better matching of the load (L) and actuator forces (P).

The variable, discrete actuator forces are generated by the high pressure working fluid (F) acting on an extension surface 130 or a retraction surface 132 of each piston 106. The surfaces 130 and 132 may have equal or different areas. Since, in this example, these surfaces have different areas, then several discrete forces may be generated as illustrated in the table of FIG. 8 where: Valve closed=0; Valve Open=1; Ax=area of extension surface 130X; Ay=area of extension surface 130Y; Arx=area of rod 112X; Ary=area of rod 112Y; Aex=area of retraction surface 132X; Aey=area of retraction surface 132Y; +P=pressure moving piston in (+) direction in an energy consuming mode; −P=pressure moving piston in (−) direction in an energy consuming mode; +L=load moving in (+) direction in an energy recovery mode; and −L=load moving in (−) direction in an energy recovery mode.

Figure 9:
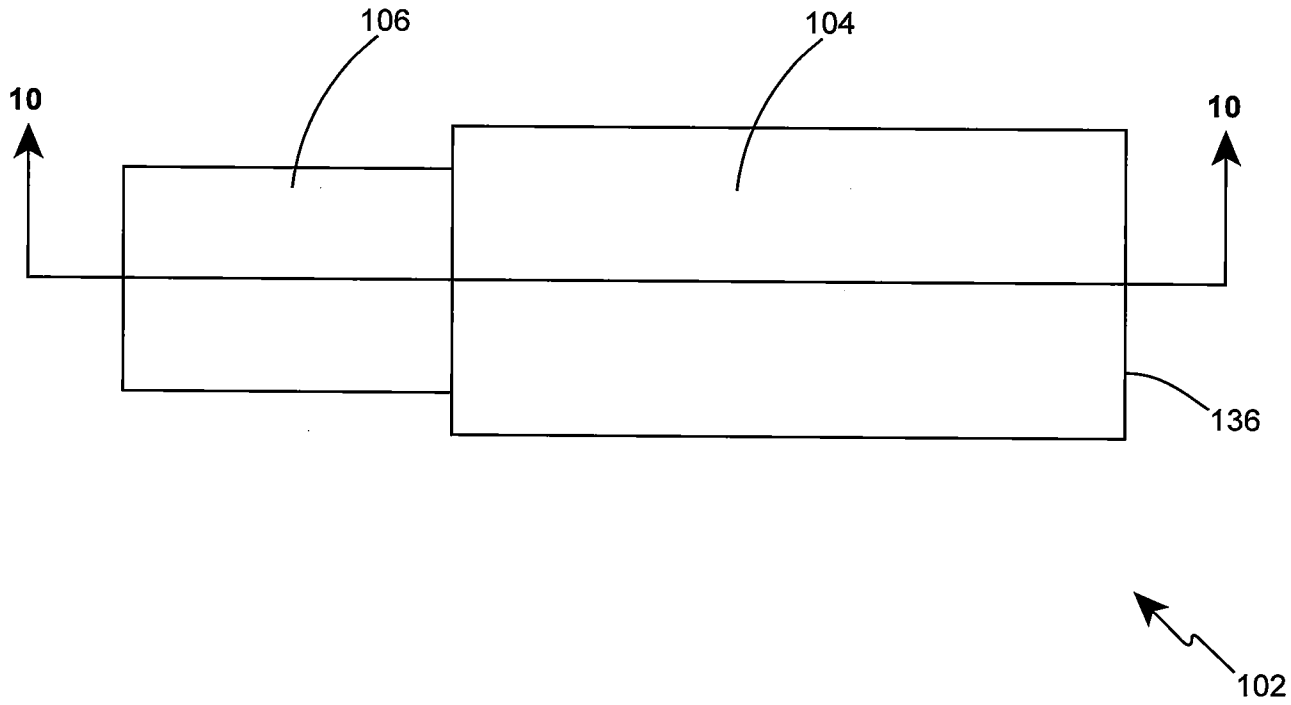
FIG. 9 is a plan view of a single-acting, concentric cylinder providing several discrete forces.
Figure 10:
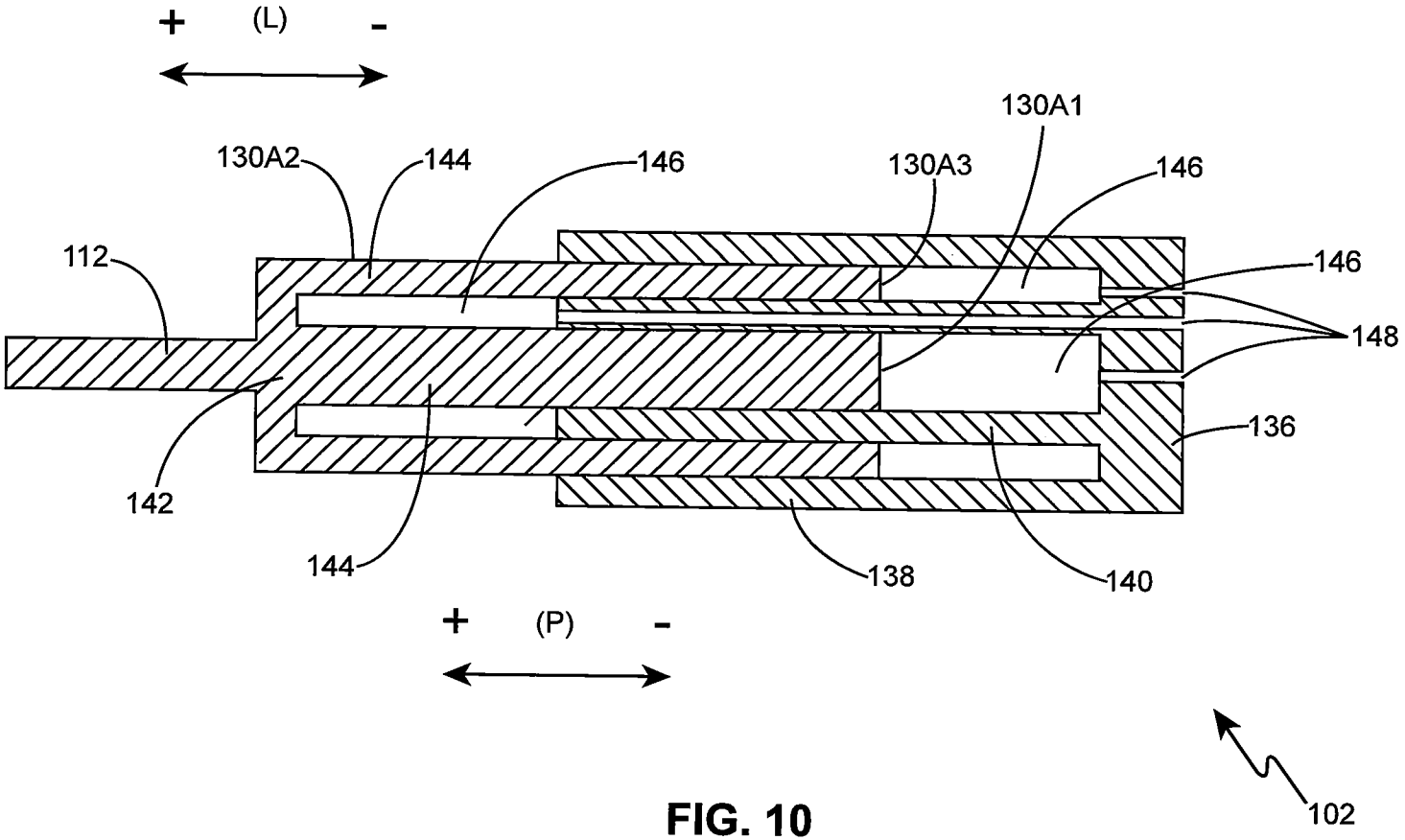
FIG. 10 is a cross sectional view of the cylinder of FIG. 9 and taken along line 10-10 of FIG. 9.

FIGS. 9 and 10 illustrate an example of a single-acting hydraulic actuation cylinder 102 for use in a system 100 that is capable of a number of variable, discrete, forces. In this example, a cylinder barrel 104 includes a circular cap end wall 136 and a tubular outer wall 138 extending from the cap end wall 136 and circumscribing an axially-extending, longitudinal centerline. Concentric inner walls 140 are spaced radially inward of the outer wall 138 and extend axially from the cap end wall 136. In this example, a single, inner wall 140 is shown, but in other examples, two or more concentric, inner walls 140 are contemplated.

A piston 106 includes a base wall 142 and concentric walls 144 spaced radially outward of one another and axially extending from the base wall 142. In some examples, the walls 144 can be solid as shown in the central wall, or hollow as is shown in the outer most wall. The piston 106 may also include a rod 112 that extends from the base wall 142 in the opposite direction as the concentric walls 144. The piston 106 engages an external load (L), which may produce a force directed in an opposite direction as the piston 106 force (+P) in an energy consuming mode, or in the same direction as the piston 106 force (−P) in an energy recovery mode.

The piston 106 is disposed within the cylinder barrel 104 and aligned coaxially about the common, longitudinal axis. The piston 106 is sized to allow movement into and out of the barrel 104 with a minimum of clearance. The concentric walls 140 of the barrel 104 and the concentric walls 144 of the piston 106 cooperate to define a plurality of concentric extension chambers 146. The term cooperate in this sense means that the concentric walls "stack" radially and "overlap" axially to define enclosed extension chambers 146. In this example, three extension chambers 146 are defined, but other examples may contain a different number.

A series of ports 148 extend through the cap end wall 136 and inner walls 140 to allow a pressurized working fluid (F) to flow into and out of the extension chambers 146 via valves. A low pressure valve 120 fluidly couples each extension chamber 146 to a low pressure reservoir 114 and a high pressure valve 122 fluidly couples each extension chamber 146 to a high pressure accumulator 116 as illustrated in the earlier examples. Each of the valves 114, 116 may be independently configured in an open position or a closed position by a controller 126 as previously described above with respect to both of the energy consuming and energy recovery modes of operation.

An active extension chamber indicates that the chamber is pressurized and is contributing to a force (+P) applied to the piston 106 in the energy consuming mode, or receiving a force (−L) from the load in the energy recovery mode. A passive extension chamber indicates that the chamber is not contributing to the consumption or recovery of energy. Please note that this particular embodiment illustrates a single-acting hydraulic cylinder that will only generate a force in a single, piston-extending direction (+P) and recover energy from the load (−L) in a piston-retracting direction (−P).

The piston 106 includes extension surfaces 130A1, 130A2, 130A3 that are circular or annular shaped. The extension surfaces 130A1, 130A2, 130A3 have areas that may be equal or unequal in size and produce several discrete forces by the system 100 as illustrated in the table of FIG. 11 where: Valve Open=1; Valve Closed=0; A1=area of extension surface 130A1; A2=area of extension surface 130A2; A3=area of extension surface 130A3; +P=fluid pressure moving piston in (+) direction (extending) in energy consuming mode; and −L=load moving piston in (−) direction (retracting) in energy recovery mode.

Since this particular example is a single-acting system 100, there are only two modes of operation. When the system is configured in an energy consuming mode and the load force (−L) is in an opposite direction as an extending piston force direction (+P), the high pressure valves 122 fluidly coupling the active extension chambers 146A to the high pressure accumulator 116 are configured in an open position. The low pressure valves 120 fluidly coupling the passive extension chambers 146P to the low pressure reservoir 114 are configured in an open position. All other valves are configured in a closed position.

When the system is configured in an energy recovery mode and the load force (−L) is in the same direction as a retracting piston force (−P), the high pressure valves 122 fluidly coupling the active extension chambers 146A to the high pressure accumulator 116 are configured in an open position. The low pressure valves 120 fluidly coupling the passive extension chambers 146P to the low pressure reservoir 114 are configured in an open position. All other valves are configured in a closed position.

Figure 12:
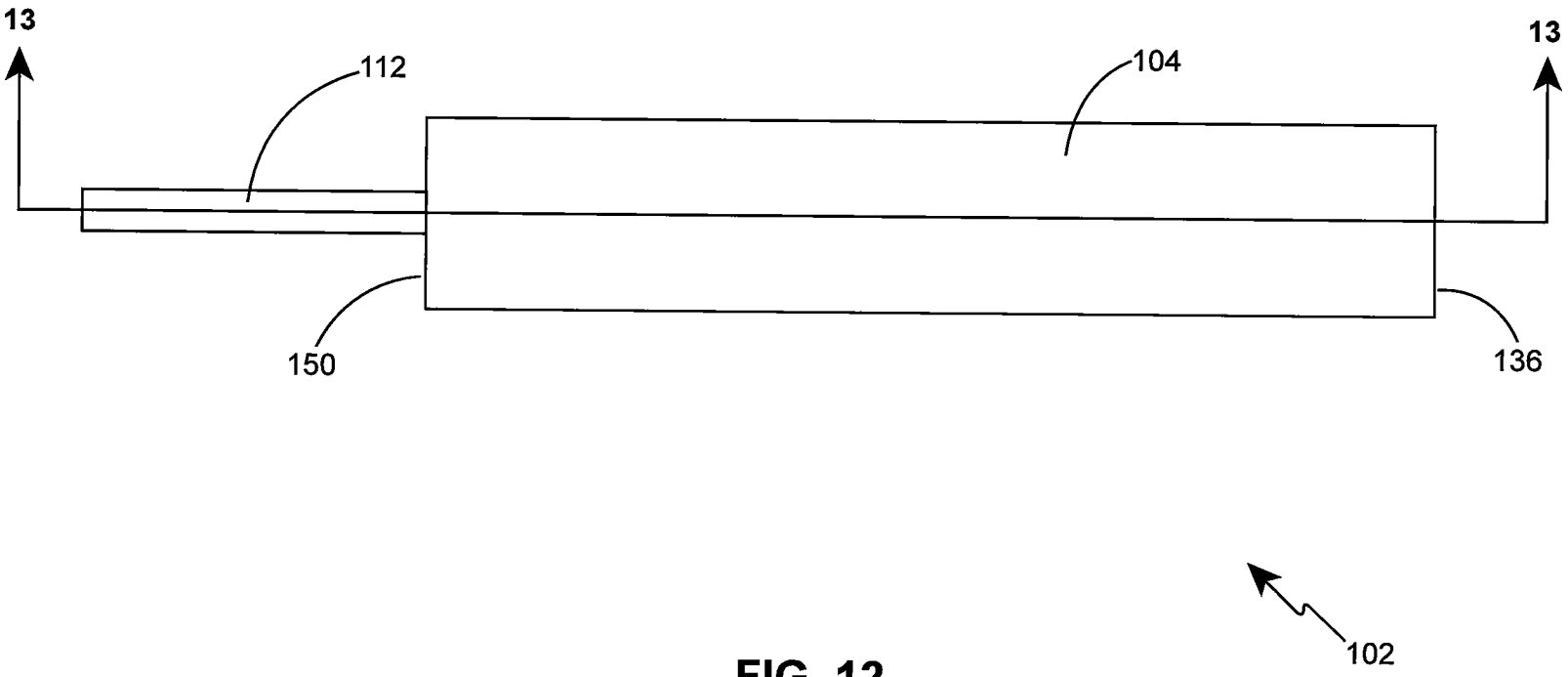
FIG. 12 is a plan view of a double-acting, concentric cylinder providing several discrete forces.
Figure 13:
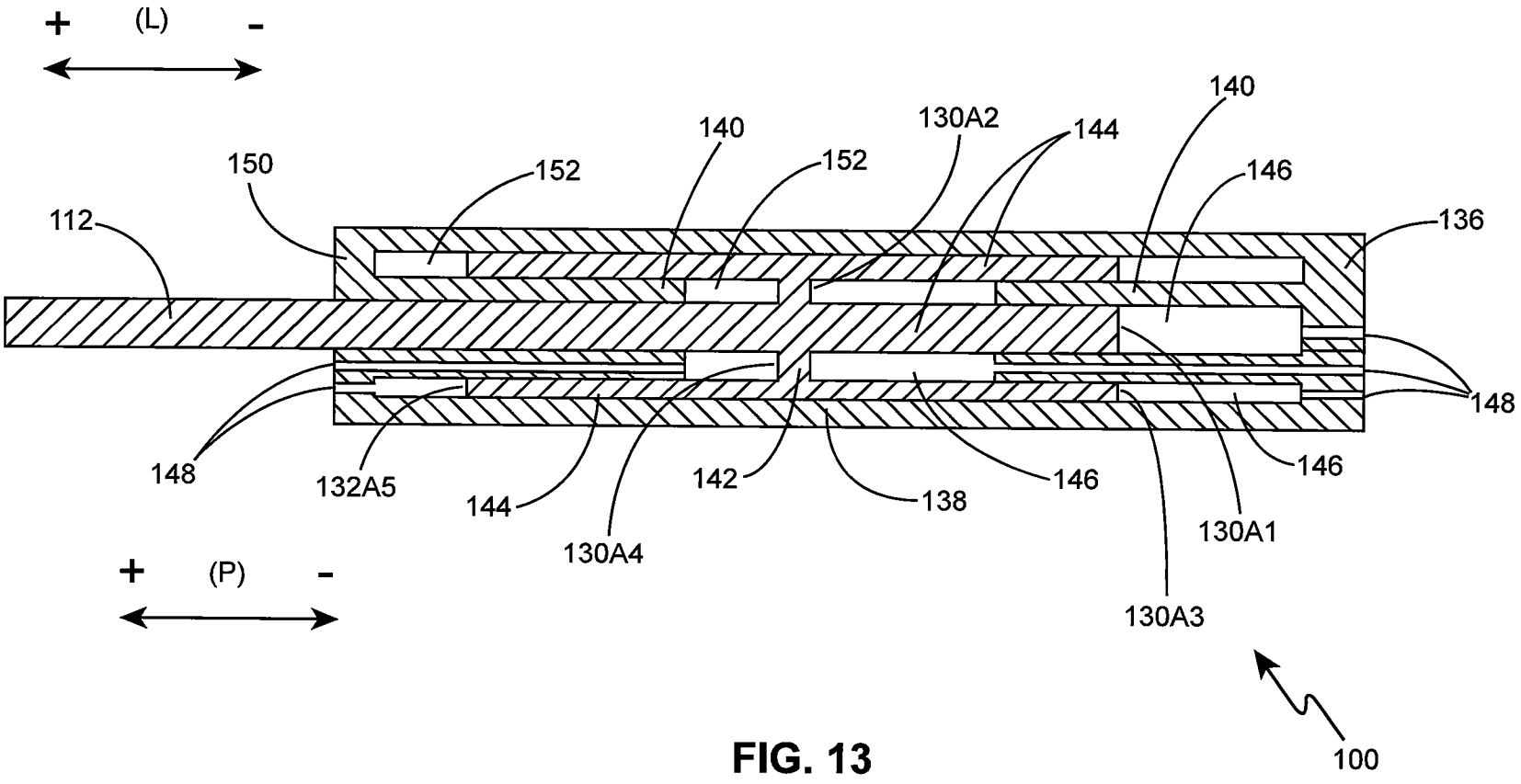
FIG. 13 is a cross sectional view of the cylinder of FIG. 12 and taken along line 13-13.

FIGS. 12-13 illustrate an example of a hydraulic actuation cylinder 102 for use in a system 100 that is capable of a number of variable, discrete, forces. In this example, a cylinder barrel 104 includes a circular cap end wall 136, a rod end wall 150 and a tubular outer wall 138 extending from the cap end wall 136 to the rod end wall 150 and circumscribing an axially-extending, longitudinal centerline. Concentric inner walls 140 are spaced radially inward of the outer wall 138 and extend axially toward each other from the cap end wall 136 and the rod end wall 150. In this example, a single, inner wall 140 is shown extending from the cap end wall 136 and the rod end wall 150, but in other examples, more inner walls 140 are contemplated. The walls can be solid (e.g., cylindrical) or hollow (e.g., tubular).

A piston 106 includes a base wall 142 and concentric walls 144 spaced radially outward of one another and axially extending from the base wall 142 in opposite directions. In some examples, the walls can be solid (e.g., cylindrical) as shown in the innermost wall, or hollow (e.g., tubular) as is shown in the outermost wall. The piston 106 may also include a rod 112 that extends from the base wall 142. The piston 106 engages an external load (L), which may produce a force directed in an opposite direction as the piston 106 force (P) in the energy consuming modes, or in the same direction in the energy recovery modes.

The piston 106 is disposed within the cylinder barrel 104 and aligned coaxially about the central, longitudinal axis. The piston 106 is sized to allow movement into and out of the barrel 104 with a minimum of clearance. The concentric walls 140 of the barrel 104 and the concentric walls 144 of the piston 106 cooperate to define a plurality of concentric extension chambers 146 and retraction chambers 152 The term cooperate in this sense means that the concentric walls "stack" together radially and "overlap" axially to define pressure chambers. In this example, three extension chambers 146 and two retraction chambers 152 are defined, but other examples may contain different numbers. Note that in this example, a removable (e.g., threaded) rod end wall 150 or a barrel 104 that is split longitudinally is necessary to install the piston 106 inside the barrel 104.

A series of ports 148 extend through the cap end wall 136, rod end wall 150 and inner walls 140 to allow a pressurized working fluid (F) to flow into and out of the extension chambers 146 and retraction chambers 152. A low pressure valve 120 fluidly couples each extension chamber 146 and retraction chamber 152 to a low pressure reservoir 114 and a high pressure valve 122 fluidly couples each extension chamber 146 and retraction chamber 152 to a high pressure accumulator 116 as in the earlier examples. Each of the valves 120, 122 may be independently configured in an open position or a closed position by a controller 126 as previously described above with respect to the energy consuming and energy recovery modes of operation.

An active extension 146A or retraction chamber 152A indicates that the chamber is pressurized and is applying a load to the piston 106 in the energy consuming modes, or receiving a load from the piston 106, rod 112 and load (L) in the energy recovery modes. A passive extension 146P or retraction chamber 152P indicates that the chamber is not contributing to the consumption or recovery of energy. Please note that this particular example illustrates a double-acting hydraulic cylinder that will generate forces in both piston-extending (+P) and piston-retracting directions (−P).

The piston 106 includes extension surfaces 130A1, 130A2, 130A3 and retraction surfaces 132A4, 132A5 that are circular or annular shaped. The surfaces have areas that may be equal in size or unequal in size and produce numerous, discrete, forces when contributing to the piston forces (+P), (−P) or recovering load forces (+L), (−L).

Since this particular example is a double-acting system, there are four modes of operation. When the system is configured in an energy consuming mode and the load force (−L) is in an opposite direction as an extending piston force (+P), the high pressure valves 122 fluidly coupling the active extension chambers 146A and the active retraction chambers 152A to the high pressure accumulator 116 are configured in an open position. The low pressure valves 120 fluidly coupling the passive extension chambers 146P and passive retraction chambers 152P to the low pressure reservoir 114 are configured in a open position. All other valves are configured in a closed position.

When the system is configured in an energy consuming mode and the load force (+L) is in an opposite direction as a retracting piston force (−P), the high pressure valves 122 fluidly coupling the active extension chambers 146A and the active retraction chambers 152A to the high pressure accumulator 116 are configured in an open position. The low pressure valves 120 fluidly coupling the passive extension chambers 146P and passive retraction chambers 152P to the low pressure reservoir 114 are configured in an open position. All other valves are configured in a closed position.

When the system is configured in an energy recovery mode and the load force (+L) is in the same direction as an extending piston (+P), the high pressure valves 122 fluidly coupling the active retraction chambers 152A to the high pressure accumulator 116 are configured in an open position. The low pressure valves 120 coupling the passive retraction chambers 152P and the active extension chambers 146A and the passive extension chambers 146P to the low pressure reservoir 114 are configured in an open position. All other valves are configured in a closed position.

When the system is configured in an energy recovery mode and the load force (−L) is in the same direction as a retracting piston (−P), the high pressure valves 122 fluidly coupling the active extension chambers 146A to the high pressure accumulator 116 are configured in an open position. The low pressure valves 120 fluidly coupling the active retraction chambers 152A and the passive retraction chambers 152P and the passive extension chambers 146P to the low pressure reservoir 114 are configured in an open position. All other valves are configured in a closed position.

Note that in this example of a cylinder 102, an extension chamber 146A and a retraction chamber 152A may be active at the same time. As such, a large number of discrete, forces can be produced in each of the four modes of operation and a chart depicting each of the possibilities is lengthy and is not included as in the earlier examples for brevity.

Figure 14:
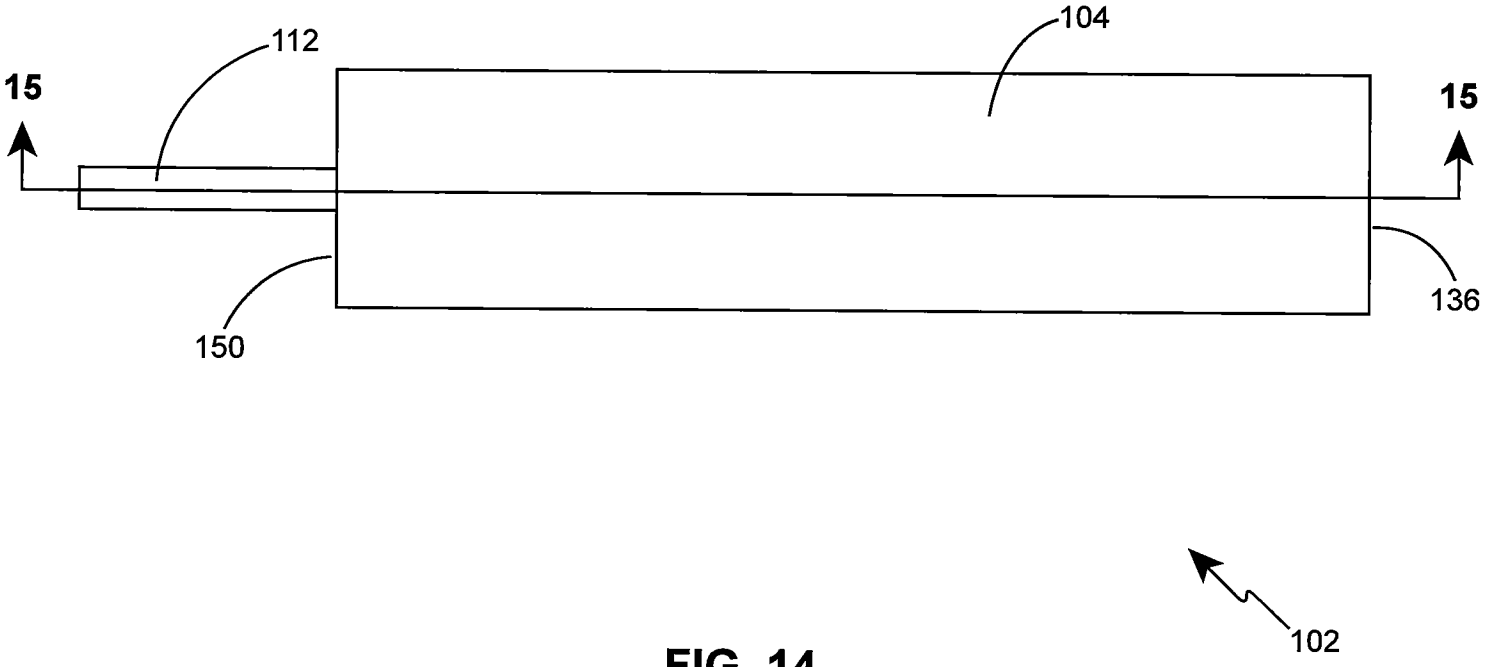
FIG. 14 is a plan view of a double-acting, concentric cylinder providing several discrete forces.
Figure 15:
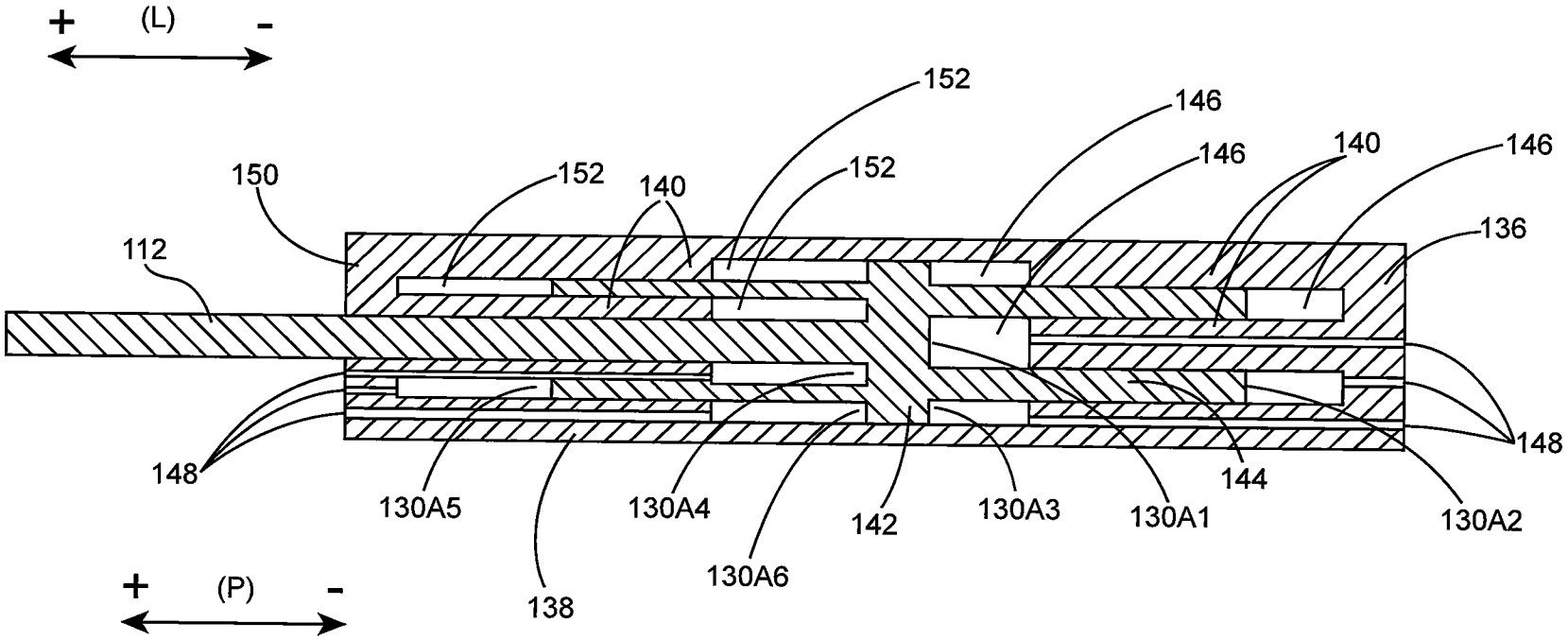
FIG. 15 is a cross sectional view of the cylinder of FIG. 14 and taken along line 15-15.

FIGS. 14-15 illustrate another example of a double-acting hydraulic actuation cylinder 102 for use in a system 100 that is capable of a number of variable, discrete, forces. In this example, a cylinder barrel 104 includes a circular cap end wall 136, a rod end wall 150 and a tubular outer wall 138 extending from the cap end wall 136 to the rod end wall 150 and circumscribing an axially-extending, longitudinal centerline. Concentric inner walls 140 are spaced radially inward of the outer wall 138 and extend axially toward each other from the cap end wall 136 and the rod end wall 150. In this example, multiple inner walls 140 are shown extending from the cap end wall 136 and the rod end wall 150, but in other examples, more or less inner walls 140 are contemplated. The walls can be solid (e.g., cylindrical) or hollow (e.g., tubular). In this particular example, there are inner walls 140 that extend radially outward and contact the outer wall 138.

A piston 106 includes a base wall 142 and concentric walls 144 spaced radially outward of one another and axially extending from the base wall 142 in opposite directions. In some examples, the walls can be solid (e.g., cylindrical), or the walls may be hollow (e.g., tubular) as in the present example. The piston 106 may also include a rod 112 that extends from the base wall 142. The piston 106 engages an external load (L), which may produce a force directed in an opposite direction as the piston 106 in the energy consuming modes, or in the same direction as the piston 106 in the energy recovery modes.

The piston 106 is disposed within the hydraulic cylinder barrel 104 and aligned coaxially about the central, longitudinal axis. The piston 106 is sized to allow movement into and out of the barrel 104 with a minimum of clearance. The concentric walls 140 of the barrel 104 and the concentric walls 144 of the piston 106 cooperate to define a plurality of concentric extension chambers 146 and retraction chambers 152. The term cooperate in this sense means that the concentric walls "stack" together radially and "overlap" axially to define pressure chambers. In this example, three extension chambers 146 and three retraction chambers 152 are defined, but other examples may contain different numbers. In this example, a removable rod end wall 150 or a barrel 104 that is split longitudinally is necessary to install the piston 106 inside the barrel 104.

A series of ports 148 extend through the cap end wall 136, rod end wall 150 and inner walls 140 to allow a pressurized working fluid (F) to flow into and out of the extension chambers 108 and retraction chambers 110. A low pressure valve 120 fluidly couples each extension chamber 108 and retraction chamber 110 to a low pressure reservoir 114 and a high pressure valve 122 fluidly couples each extension chamber 108 and retraction chamber 110 to a high pressure accumulator 116 as in the earlier examples. Each of the valves 120, 122 may be independently configured in an open position or a closed position by a controller 126 as previously described above with respect to the energy consuming and energy recovery modes of operation.

An active extension 146A or retraction chamber 152A indicates that the chamber is pressurized and is applying a load to the piston 106 in the energy consuming mode, or receiving a load from the piston 106 in the energy recovery mode. A passive extension 146P or retraction chamber 152P indicates that the chamber is not contributing to the consumption or recovery of energy. Please note that this particular example illustrates a double-acting hydraulic cylinder that will generate forces in both the piston-extending (+P) and piston-retracting (−P) directions.

The piston 106 includes extension surfaces 130A1, 130A2 and 130A3 and retraction surfaces 132A4, 132A5 and 132A6 that are circular or annular shaped. The surfaces have areas that may be equal in size or unequal in size and produce numerous, discrete, forces when contributing to the piston forces (+P), (−P) or recovering load forces (+L), (−L).

Since this particular example is a double-action system, there are four modes of operation. When the system is configured in an energy consuming mode and the load force (−L) is in an opposite direction as an extending piston force (+P), the high pressure valves 122 fluidly coupling the active extension chambers 146A and the active retraction chambers 152A to the high pressure accumulator 116 are configured in an open position. The low pressure valves 120 fluidly coupling the passive extension chambers 146P and passive retraction chambers 152P to the low pressure reservoir 114 are configured in an open position. All other valves are configured in a closed position.

When the system is configured in an energy consuming mode and the load force (+L) is in an opposite direction as a retracting piston force (−P), the high pressure valves 122 fluidly coupling the active extension chambers 146A and the active retraction chambers 152A to the high pressure accumulator 116 are configured in an open position. The low pressure valves 120 fluidly coupling the passive extension chambers 146P and passive retraction chambers 152P to the low pressure reservoir 114 are configured in an open position. All other valves are configured in a closed position.

When the system is configured in an energy recovery mode and the load force (+L) is in the same direction as an extending piston (+P), the high pressure valves 122 fluidly coupling the active retraction chambers 152A to the high pressure accumulator 116 are configured in an open position. The low pressure valves 120 coupling the passive retraction chambers 152P and the active extension chambers 146A and the passive extension chambers 146P to the low pressure reservoir 114 are configured in an open position. All other valves are configured in a closed position.

When the system is configured in an energy recovery mode and the load force (−L) is in the same direction as a retracting piston (−P), the high pressure valves 122 fluidly coupling the active extension chambers 146A to the high pressure accumulator 116 are configured in an open position. The low pressure valves 120 fluidly coupling the active retraction chambers 152A and the passive retraction chambers 152P and the passive extension chambers 146P to the low pressure reservoir 114 are configured in an open position. All other valves are configured in a closed position.

Note that in this example of a cylinder 102, an extension chamber 146A and a retraction chamber 152A may be active at the same time. As such, a large number of discrete, forces can be produced in each of the four modes of operation and a chart depicting each of the possibilities is lengthy and is not included as in the earlier examples for brevity.

While this disclosure describes and enables several examples of hydraulic actuation systems with discrete force and energy recovery capabilities, other examples and applications are contemplated. Accordingly, the invention is intended to embrace those alternatives, modifications, equivalents, and variations as fall within the broad scope of the appended claims. The technology disclosed and claimed herein may be available for licensing in specific fields of use by the assignee of record.

What is claimed is:

1. An energy efficient, fluid powered, single-acting, linear actuation system comprising:

a hydraulic cylinder barrel having a cap end wall, a tubular outer wall extending from the cap end wall and circumscribing an axially-extending, longitudinal centerline, and concentric inner walls spaced radially inward of the outer wall and extending axially from the cap end wall;

a piston for engaging a load force, said piston having a base wall, concentric walls spaced radially outward of one another and axially extending from the base wall, said piston is disposed within said hydraulic cylinder barrel and the concentric walls of said barrel and the concentric walls of said piston cooperate to define a plurality of concentric extension chambers;

a low pressure valve fluidly coupling each of the extension chambers to a common low pressure reservoir;

a high pressure valve fluidly coupling each of the extension chambers to a common high pressure accumulator;

a working fluid disposed within at least the chambers, valves, low pressure reservoir and high pressure accumulator;

wherein, when the system is configured in an energy consuming mode and the load force is in an opposite direction as an extending piston force direction, the high pressure valves fluidly coupling the active extension chambers to the high pressure accumulator are configured in an open position, and the low pressure valves fluidly coupling the passive extension chambers to the low pressure reservoir are configured in an open position and all other valves are configured in a closed position; and when the system is configured in an energy recovery mode and the load force is in the same direction as a retracting piston force, the high pressure valves fluidly coupling the active extension chambers to the high pressure accumulator are configured in an open position and the low pressure valves fluidly coupling the passive extension chambers to the low pressure reservoir are configured in an open position and all other valves are configured in a closed position.

2. The single-acting linear actuation system of claim 1 and further comprising a controller for configuring each of the valves in either of an open position or a closed position in response to the load force magnitude and direction.

3. The single-acting linear actuation system of claim 2 and further comprising a pump fluidly coupled between said low pressure reservoir and said high pressure accumulator.

4. The single-acting linear actuation system of claim 1 wherein said piston includes a plurality of working surfaces and wherein each of the working surfaces include a surface area that is not identical in size to the other working surface areas.

5. An energy efficient, fluid powered, single-acting, linear actuation system comprising:

a hydraulic cylinder barrel having a cap end wall, a tubular outer wall extending from the cap end wall and circumscribing an axially-extending, longitudinal centerline, and concentric inner walls spaced radially inward of the outer wall and extending axially from the cap end wall;

a piston for engaging a load force, said piston having a base wall, concentric walls spaced radially outward of one another and axially extending from the base wall, said piston is disposed within said hydraulic cylinder barrel and the concentric walls of said barrel and the concentric walls of said piston cooperate to define a plurality of concentric extension chambers; and wherein said piston includes a plurality of working surfaces and wherein each of the working surfaces include a surface area that is identical in size to the other working surface areas.

6. An energy efficient, fluid powered, double-acting, linear actuation system comprising:

a hydraulic cylinder barrel having a cap end wall, a rod end wall, a tubular outer wall extending between the cap end wall to the rod end wall and circumscribing an axially-extending, longitudinal centerline, and concentric inner walls spaced radially inward of the outer wall and extending axially from the cap end wall and the rod end wall;

a piston for engaging a load force, said piston having a base, concentric walls spaced radially outward of one another and axially extending from the base in opposite directions, said piston is disposed within said hydraulic cylinder barrel and the walls of said barrel and the walls of said piston cooperate to define a plurality of concentric extension chambers disposed between the piston base and the cap end wall and a plurality of concentric retraction chambers disposed between the piston base and the rod end wall;

a working fluid disposed within at least the chambers, valves, low pressure reservoir and high pressure accumulator; and wherein, when the system is configured in an energy consuming mode and the load force is in an opposite direction as an extending piston force, the high pressure valves fluidly coupling the active extension chambers and the active retraction chambers to the high pressure accumulator are configured in an open position and the low pressure valves fluidly coupling the passive extension chambers and passive retraction chambers to the low pressure reservoir are configured in a open position, and all other valves are configured in a closed position, and when the system is configured in an energy consuming mode and the load force is in an opposite direction as a retracting piston force, the high pressure valves fluidly coupling the active extension chambers and the active retraction chambers to the high pressure accumulator are configured in an open position and the low pressure valves fluidly coupling the passive extension chambers and passive retraction chambers to the low pressure reservoir are configured in a open position, and all other valves are configured in a closed position, and when the system is configured in an energy recovery mode and the load force is in the same direction as an extending piston, the high pressure valves fluidly coupling the active retraction chambers to the high pressure accumulator are configured in an open position and the low pressure valves coupling the passive retraction chambers and the active extension chambers and the passive extension chambers to the low pressure reservoir are configured in an open position, and all other valves are configured in a closed position, and when the system is configured in an energy recovery mode and the load force is in the same direction as a retracting piston, the high pressure valves fluidly coupling the active extension chambers to the high pressure accumulator are configured in an open position and the low pressure valves fluidly coupling the active retraction chambers and the passive retraction chambers and the passive extension chambers the low pressure reservoir are configured in an open position, and all other valves are configured in a closed position.

7. The double-acting linear actuation system of claim 6 and further comprising a controller for configuring each of the valves in either of an open position or a closed position in response to the load force magnitude and direction.

8. The double-acting linear actuation system of claim 7 and further comprising a pump fluidly coupled between said low pressure reservoir and said high pressure accumulator.

9. The double-acting linear actuation system of claim 6 and further comprising:

a low pressure valve fluidly coupling each of the extension chambers and retraction chambers to a common low pressure reservoir; and a high pressure valve fluidly coupling each of the extension chambers and retraction chambers to a common high pressure accumulator.

10. The double-acting linear actuation system of claim 6 wherein said piston includes a plurality of working surfaces and wherein each of the working surfaces include a surface area that is not identical in size to the other working surface areas.

11. An energy efficient, fluid powered, double-acting, linear actuation system comprising:

a hydraulic cylinder barrel having a cap end wall, a rod end wall, a tubular outer wall extending between the cap end wall to the rod end wall and circumscribing an axially-extending, longitudinal centerline, and concentric inner walls spaced radially inward of the outer wall and extending axially from the cap end wall and the rod end wall;

a piston for engaging a load force, said piston having a base, concentric walls spaced radially outward of one another and axially extending from the base in opposite directions, said piston is disposed within said hydraulic cylinder barrel and the walls of said barrel and the walls of said piston cooperate to define a plurality of concentric extension chambers disposed between the piston base and the cap end wall and a plurality of concentric retraction chambers disposed between the piston base and the rod end wall; and wherein said piston includes a plurality of working surfaces and wherein each of the working surfaces include a surface area that is identical in size to the other working surface areas.

* * * * *